US009054446B2

(12) United States Patent
O'Sullivan et al.

(10) Patent No.: US 9,054,446 B2
(45) Date of Patent: Jun. 9, 2015

(54) ELECTRICAL CONNECTORS AND METHODS FOR USING SAME

(71) Applicants: Tyco Electronics Corporation, Berwyn, PA (US); Tyco Electronics Brasil LTDA, Sao Paolo (BR)

(72) Inventors: Edward O'Sullivan, Cary, NC (US); Jose Alexandre La Salvia, Sao Jose dos Campos (BR); Charles Hills, Holly Springs, NC (US); Matthew P. Galla, Holly Springs, NC (US); Mahmoud K. Seraj, Apex, NC (US); George Triantopoulos, Apex, NC (US)

(73) Assignees: Tyco Electronics Corporation, Berwyn, PA (US); Tyco Electronics Brasil LTDA, Sao Paolo (BR)

( * ) Notice: Subject to any disclaimer, the term of this patent is extended or adjusted under 35 U.S.C. 154(b) by 191 days.

(21) Appl. No.: 13/833,738

(22) Filed: Mar. 15, 2013

(65) Prior Publication Data

US 2014/0273599 A1 Sep. 18, 2014

Related U.S. Application Data

(63) Continuation of application No. 13/804,956, filed on Mar. 14, 2013.

(51) Int. Cl.
*H01R 11/09* (2006.01)
*H01R 13/52* (2006.01)
(Continued)

(52) U.S. Cl.
CPC ..... *H01R 13/5219* (2013.01); *H01R 43/20* (2013.01); *H01R 13/62* (2013.01); *H01R 4/4872* (2013.01); *H01R 4/52* (2013.01); *H01R 11/09* (2013.01); *H01R 13/5216* (2013.01)

(58) Field of Classification Search
CPC ..... H02G 15/013; H01G 15/18; H01R 4/646; H01R 4/70; H01R 4/20; H01R 4/08; H01R 11/286; H01R 4/36; H01R 4/5083; H01R 4/5025; H01R 4/52; H01R 13/59; F16G 11/04
USPC .... 24/136 R; 174/74 R, 84 C, 84 R, 84 S, 78, 174/88 R, 90–93; 439/462, 769, 783, 784, 439/796, 820, 863
See application file for complete search history.

(56) References Cited

U.S. PATENT DOCUMENTS 2,078,051 A * 4/1937 Berndt ..... 439/788
2,128,832 A * 8/1938 Lusher ..... 403/303

(Continued)

OTHER PUBLICATIONS

International Search Report and Written Opinion Corresponding to International Application No. PCT/US2014/022575: Date of Mailing: Jul. 3, 2014 (9 pages).

(Continued)

*Primary Examiner* — Thanh Tam Le
(74) *Attorney, Agent, or Firm* — Myers Bigel Sibley & Sajovec, PA

(57) ABSTRACT

An electrical connector for forming a mechanical and electrical coupling with an electrical conductor includes a tubular housing, at least one jaw member, a sealant containment membrane, and a sealant. The tubular housing has a connector axis. The housing defines a conductor receiving opening and an interior cavity each configured to receive the conductor along the connector axis. The at least one jaw member is configured to clamp the conductor within the interior cavity. The sealant containment membrane is disposed in the interior cavity and defines a sealant chamber. The sealant is contained in the sealant chamber in the interior cavity to environmentally protect an electrical contact engagement between the conductor and the electrical connector when the conductor is clamped in the interior cavity by the at least one jaw member.

10 Claims, 14 Drawing Sheets

(51) Int. Cl.

| | |
|---|---|
| ***H01R 43/20*** | (2006.01) |
| ***H01R 13/62*** | (2006.01) |
| ***H01R 4/48*** | (2006.01) |
| *H01R 4/52* | (2006.01) |

(56) References Cited

U.S. PATENT DOCUMENTS

| | | | | | |
|---|---|---|---|---|---|
| 2,158,892 | A | * | 5/1939 | Becker | 439/863 |
| 2,222,493 | A | * | 11/1940 | Barlow | 403/303 |
| 2,859,424 | A | * | 11/1958 | Berndt | 439/788 |
| 2,966,653 | A | * | 12/1960 | Jugle | 403/314 |
| 3,550,064 | A | | 12/1970 | Caller et al. | |
| 3,673,312 | A | | 6/1972 | Vockroth | |
| 3,999,418 | A | * | 12/1976 | Morell | 72/377 |
| 4,362,352 | A | | 12/1982 | Hawkins et al. | |
| 4,648,919 | A | | 3/1987 | Diaz et al. | |
| 4,698,031 | A | * | 10/1987 | Dawson | 439/863 |
| 4,775,335 | A | * | 10/1988 | Havel | 439/820 |
| 5,070,597 | A | | 12/1991 | Holt et al. | |
| 5,278,353 | A | * | 1/1994 | Buchholz et al. | 174/84 R |
| 5,334,056 | A | | 8/1994 | Hlinsky | |
| 5,362,250 | A | | 11/1994 | McMills et al. | |
| 5,397,859 | A | | 3/1995 | Robertson et al. | |
| 5,461,198 | A | * | 10/1995 | Delalle | 174/87 |
| 5,804,767 | A | | 9/1998 | Winfield et al. | |
| 5,952,612 | A | | 9/1999 | Winfield et al. | |
| 6,730,847 | B1 | | 5/2004 | Fitzgerald et al. | |
| 6,730,849 | B2 | | 5/2004 | Koessler | |
| 6,796,854 | B2 | | 9/2004 | Mello et al. | |
| 6,817,909 | B2 | | 11/2004 | Dobrinski et al. | |
| 6,958,449 | B1 | | 10/2005 | Ziebart et al. | |
| 7,219,399 | B2 | * | 5/2007 | Tamm et al. | 24/136 R |
| 7,304,243 | B2 | | 12/2007 | Polidori | |
| 7,794,291 | B2 | | 9/2010 | Goch | |
| 7,799,995 | B2 | | 9/2010 | Mullaney et al. | |
| 7,799,996 | B2 | | 9/2010 | Tamm et al. | |
| 8,084,691 | B2 | | 12/2011 | Pullium, III et al. | |
| 8,672,699 | B2 | * | 3/2014 | Gaertner | 439/345 |
| 2003/0228807 | A1 | | 12/2003 | Mello et al. | |
| 2004/0029455 | A1 | | 2/2004 | Johnson et al. | |
| 2006/0108140 | A1 | | 5/2006 | Wiley | |
| 2007/0074378 | A1 | | 4/2007 | Tamm et al. | |
| 2009/0081909 | A1 | | 3/2009 | Goch | |
| 2009/0298358 | A1 | | 12/2009 | Tamm et al. | |
| 2012/0217062 | A1 | | 8/2012 | Cawood et al. | |

OTHER PUBLICATIONS

"Overhead Line Splices Automatic Aluminum", Hubbel Power Systems, Inc., 2001-2013, 1 page, www.hubbellpowersystems.com.

"CRS Splice", MacLean Power Systems, 2011, 1 page, www.macleanpower.com.

* cited by examiner

ELECTRICAL CONNECTORS AND METHODS FOR USING SAME

RELATED APPLICATION

The present application is a continuation of and claims priority from U.S. patent application Ser. No. 13/804,956, filed Mar. 14, 2013, the disclosure of which is incorporated herein by reference in its entirety.

FIELD OF THE INVENTION

The present invention relates to electrical connectors and, more particularly, to electrical connectors for forming a mechanical and electrical coupling with an electrical conductor.

BACKGROUND

Wedge type connectors are commonly used to splice two bare electrical conductors, to terminate a bare electrical conductor, or to tap off of a main conductor. In use, certain connectors accept a conductor end which is inserted into an end of the connector and the connector, through a spring assisted thrust, electrically and mechanically couples with the conductor without requiring the use of additional tools to actuate the connector. However, to adequately (mechanically and electrically) form the connection, a substantial tensile force typically needs to be applied to the connection via the conductor. Such connectors are commonly known as automatics and are employed to form splices in high voltage overhead cables under tension. The tension applied by the conductors provides the force required for the wedge members to develop adequate electrical and mechanical connection for proper operation.

SUMMARY OF THE INVENTION

According to embodiments of the present invention, an electrical connector for forming a mechanical and electrical coupling with an electrical conductor includes a tubular housing, at least one jaw member, a sealant containment membrane, and a sealant. The tubular housing has a connector axis. The housing defines a conductor receiving opening and an interior cavity each configured to receive the conductor along the connector axis. The at least one jaw member is configured to clamp the conductor within the interior cavity. The sealant containment membrane is disposed in the interior cavity and defines a sealant chamber. The sealant is contained in the sealant chamber in the interior cavity to environmentally protect an electrical contact engagement between the conductor and the electrical connector when the conductor is clamped in the interior cavity by the at least one jaw member.

According to method embodiments of the present invention, a method for forming a mechanical and electrical coupling with an electrical conductor includes providing an electrical connector including: a tubular housing having a connector axis, the housing defining a conductor receiving opening and an interior cavity each configured to receive the conductor along the connector axis; at least one jaw member configured to clamp the conductor within the interior cavity; a sealant containment membrane disposed in the interior cavity and defining a sealant chamber; and a sealant contained in the sealant chamber in the interior cavity to environmentally protect an electrical contact engagement between the conductor and the electrical connector. The method further includes: inserting the conductor into the interior cavity through the conductor receiving opening; clamping the conductor within the interior cavity using the at least one jaw member; and environmentally protecting an electrical contact engagement between the conductor and the electrical connector with the sealant when the conductor is clamped in the interior cavity by the at least one jaw member.

According to embodiments of the present invention, an electrical connector for forming a mechanical and electrical coupling with an electrical conductor includes a tubular housing, at least one jaw member, a spring, and a trigger mechanism. The tubular housing has a connector axis. The housing defines a conductor receiving opening and an interior cavity each configured to receive the conductor along the connector axis. The spring is provided to force the at least one jaw member to clamp the conductor within the interior cavity. The trigger mechanism is configured to retain the spring in a compressed position and, responsive to insertion of the conductor into the interior cavity through the conductor receiving opening, to collapse and permit the spring to decompress and force the at least one jaw member to clamp the conductor within the interior cavity.

According to embodiments of the present invention, an electrical connector for forming a mechanical and electrical in-line splice connection between a first electrical conductor and a second electrical conductor includes a tubular housing and a unitary jaw member. The tubular housing has a connector axis. The housing defines: a first conductor receiving opening and a first interior cavity each configured to receive the first conductor along the connector axis; and a second conductor receiving opening opposite the first conductor receiving opening and a second interior cavity opposite the first interior cavity, each configured to receive the second conductor along the connector axis. The unitary jaw member includes: a first jaw extending into the first interior cavity; and a second jaw extending into the second interior cavity. The electrical connector is configured to clamp and electrically contact the first conductor in the first interior cavity using the first jaw and to clamp and electrically contact the second conductor in the second interior cavity using the second jaw, and thereby provide electrical continuity between the first and second conductors through the unitary jaw member.

According to embodiments of the present invention, an electrical connector for forming a mechanical and electrical coupling with an electrical conductor includes a tubular housing, a jaw member, and a jaw actuation system. The tubular housing has a connector axis. The housing defines a conductor receiving opening and an interior cavity each configured to receive the conductor along the connector axis. The jaw member includes at least one jaw to clamp the conductor within the interior cavity. The jaw actuation system includes: an outer wedge member slidably mounted on the at least one jaw member; and a spring configured to forcibly displace the outer wedge member and thereby deflect and clamp the first jaw onto the first conductor.

According to embodiments of the present invention, an electrical connector for forming a mechanical and electrical coupling with an electrical conductor includes a tubular housing, a first jaw member, and a supplemental jaw member. The tubular housing has a connector axis. The housing defines a conductor receiving opening and an interior cavity each configured to receive the conductor along the connector axis. The first jaw member includes at least one first jaw to clamp the conductor within the interior cavity. The supplemental jaw member is positioned in the interior cavity between the first jaw and the conductor receiving opening. The electrical connector is configured to additionally clamp the conductor in the interior cavity using the supplemental jaw member.

According to embodiments of the present invention, an electrical connector for forming a mechanical and electrical in-line splice connection between a first electrical conductor and a second electrical conductor includes a tubular housing having a connector axis and defining: a first conductor receiving opening and a first interior cavity each configured to receive the first conductor along the connector axis; and a second conductor receiving opening opposite the first conductor receiving opening and a second interior cavity opposite the first interior cavity, each configured to receive the second conductor along the connector axis. The electrical connector further includes a conductor connecting system including: a first jaw extending into the first interior cavity; and a second jaw extending into the second interior cavity. The electrical connector is configured to clamp and electrically contact the first conductor in the first interior cavity using the first jaw and to clamp and electrically contact the second conductor in the second interior cavity using the second jaw to form an in-line splice connection. The in-line splice connection is compliant with ANSI C119.4-2004 when no tension is applied to the first and second conductors.

According to embodiments of the present invention, an electrical connector for forming a mechanical and electrical coupling with an electrical conductor includes a tubular housing and at least one jaw member. The tubular housing has a connector axis. The housing defines a conductor receiving opening and an interior cavity each configured to receive the conductor along the connector axis. The electrical connector is configured to clamp and electrically contact the first conductor within the interior cavity. The at least one jaw member includes electrical contact enhancing teeth configured to penetrate into an outer surface of the conductor to electrically couple the at least one jaw member to the conductor.

Further features, advantages and details of the present invention will be appreciated by those of ordinary skill in the art from a reading of the figures and the detailed description of the embodiments that follow, such description being merely illustrative of the present invention.

DETAILED DESCRIPTION OF EMBODIMENTS OF THE INVENTION

Figure 1:
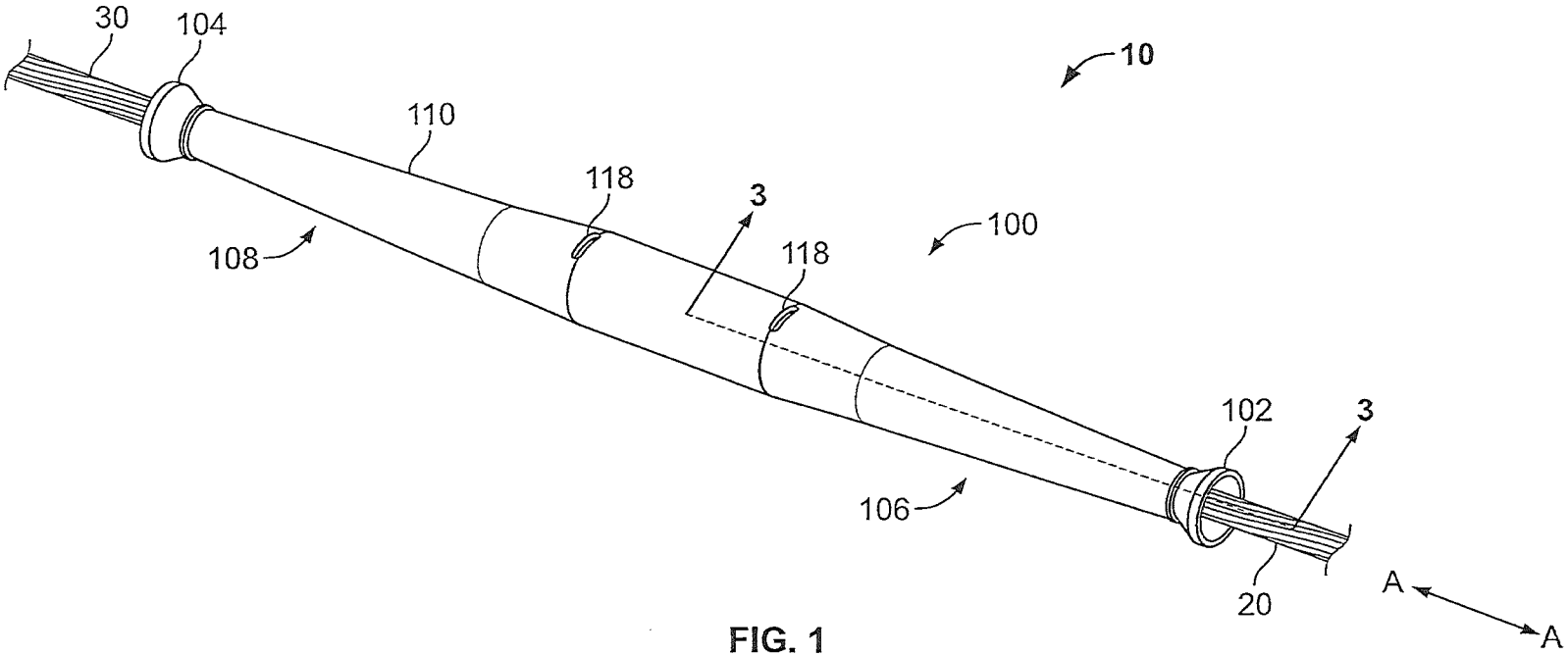
FIG. 1 is a perspective view of an in-line splice connection including an automatic cable clamp connector according to embodiments of the present invention.
Figure 2:
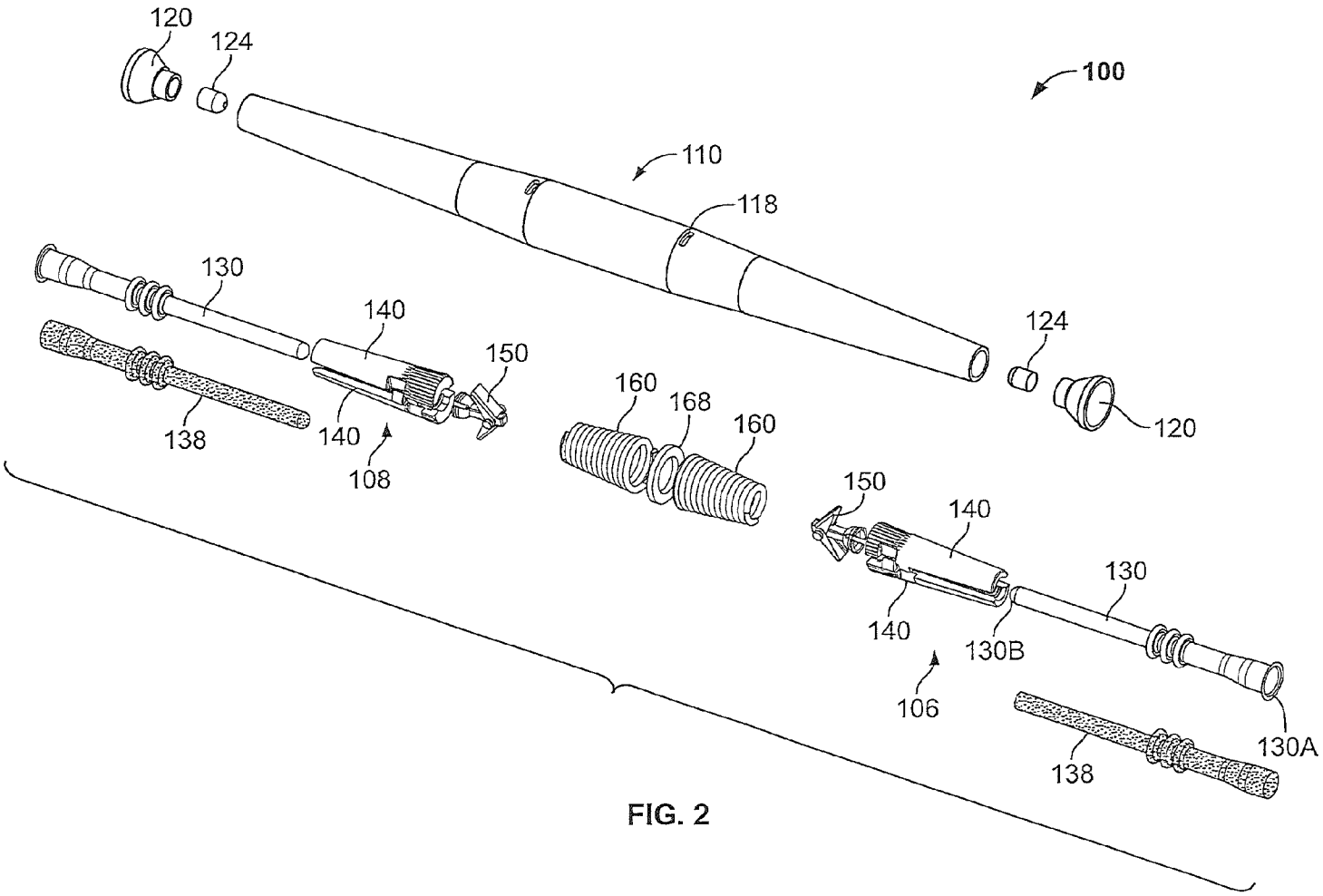
FIG. 2 is an exploded, perspective view of the automatic cable clamp connector of FIG. 1.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

With reference to FIGS. 1-7, a force-assisted automatic cable clamp connector 100 according to embodiments of the invention is shown therein. The connector 100 may be used to electrically and mechanically connect the ends of two opposed electrical conductors 20 and 30 to form an in-line splice connection 10. In some embodiments, the conductors 20, 30 can be connected (e.g., permanently connected) to the connector 100 without requiring the use of any additional tools to actuate the connector 100. According to some embodiments, the conductors 20, 30 are bare metal conductors (e.g., copper or aluminum). In some embodiments, the conductors 20, 30 each include a plurality of twisted or braided conductor filaments. According to some embodiments, the conductors 20, 30 are overhead electrical power distribution and transmission cables (e.g., bare high voltage cables).

The connector 100 includes a tubular shell or housing 110 and has a lengthwise axis A-A. The connector 100 extends lengthwise from a first end 102 to an opposing second end 104 (referred to herein as the right end and the left end, respectively, for the purpose of explanation). The housing 110 may be formed of any suitable electrically conductive material. According to some embodiments, the housing 110 is formed of steel or aluminum.

A first force-assisted, automatic connecting system 106 (referred to as the right clamping system) is provided proximate the right end 102 and a second force-assisted, automatic connecting system 108 (referred to as the left clamping system) is provided proximate the left end 104. The right connecting system 106 and the left connecting system 108 may be constructed and operate in the same manner and, therefore, only the system 106 will be described herein in further detail, it being understood that the description of the system 106 likewise applies to the left connecting system 108.

The automatic connecting system 106 includes a right side housing section 111 of the housing 110 (e.g., extending from the axial center of the housing 110 to the end 102 as shown), a guide funnel 120, a pilot cap 124, a sealant containment bladder, vessel or membrane 130, a mass of sealant 138, a pair of opposed wedges or jaw members 140, a trigger mechanism 150, a biasing member (in some embodiments, a coil spring 160 as shown), and a stop 168.

The housing section 111 is tubular and has a frusto-conical inner surface 112 that tapers inwardly axially toward the right end 102. The inner surface 112 defines an interior passage or cavity 114 extending axially from a front end 114A to a rear end 114B and terminating at an insertion or conductor receiving opening 116. Retainer slots 118 are defined in the housing section 111 proximate the rear end 114B.

Figure 3:
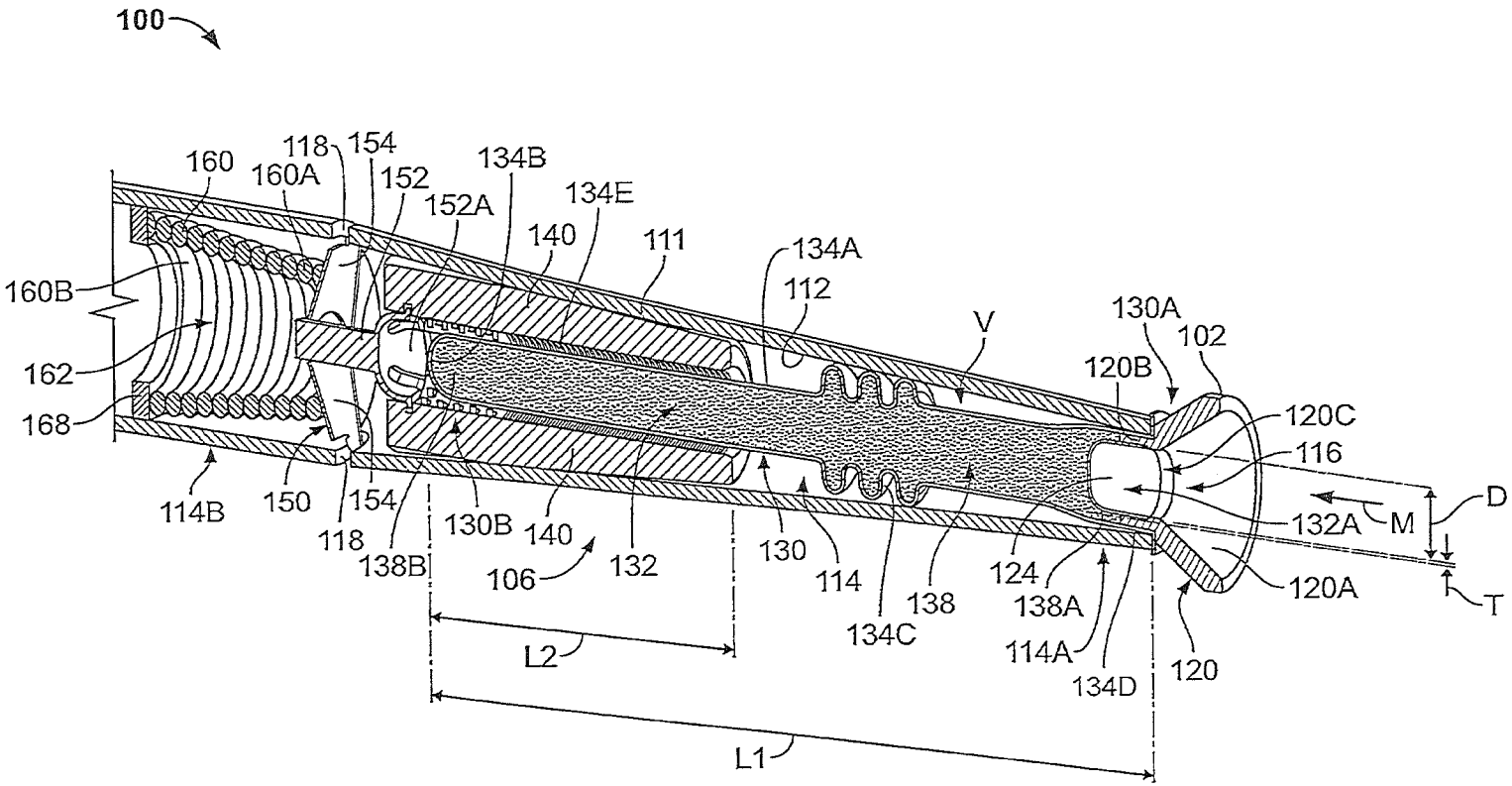
FIG. 3 is a fragmentary, cross-sectional view of the automatic cable clamp connector of FIG. 1 taken along the line 3-3 of FIG. 1.

The guide funnel 120 is located at the opening 116 and defines a through passage 120C. The funnel 120 has a receiving cone section 120A and a mating section 120B that is received in the end of the housing section 111 as shown in FIG. 3. The guide funnel 120 may be formed of any suitable materials. According to some embodiments, the guide funnel 120 is formed of a polymeric material such as polypropylene.

The annular stop 168 is located in the housing 110 at the rear end 114B and may delineate the division between the left and right sides and left and right interior cavities 114 of the housing 110. The stop 168 may be a separate element affixed (e.g., by welding, staking, crimping or the like) to the housing 110 or may be integrally formed with the housing 110. The stop 168 may be formed of any suitable material. According to some embodiments, the stop 168 is formed of a metal and, in some embodiments, the same metal as the housing 110.

Figure 6A:
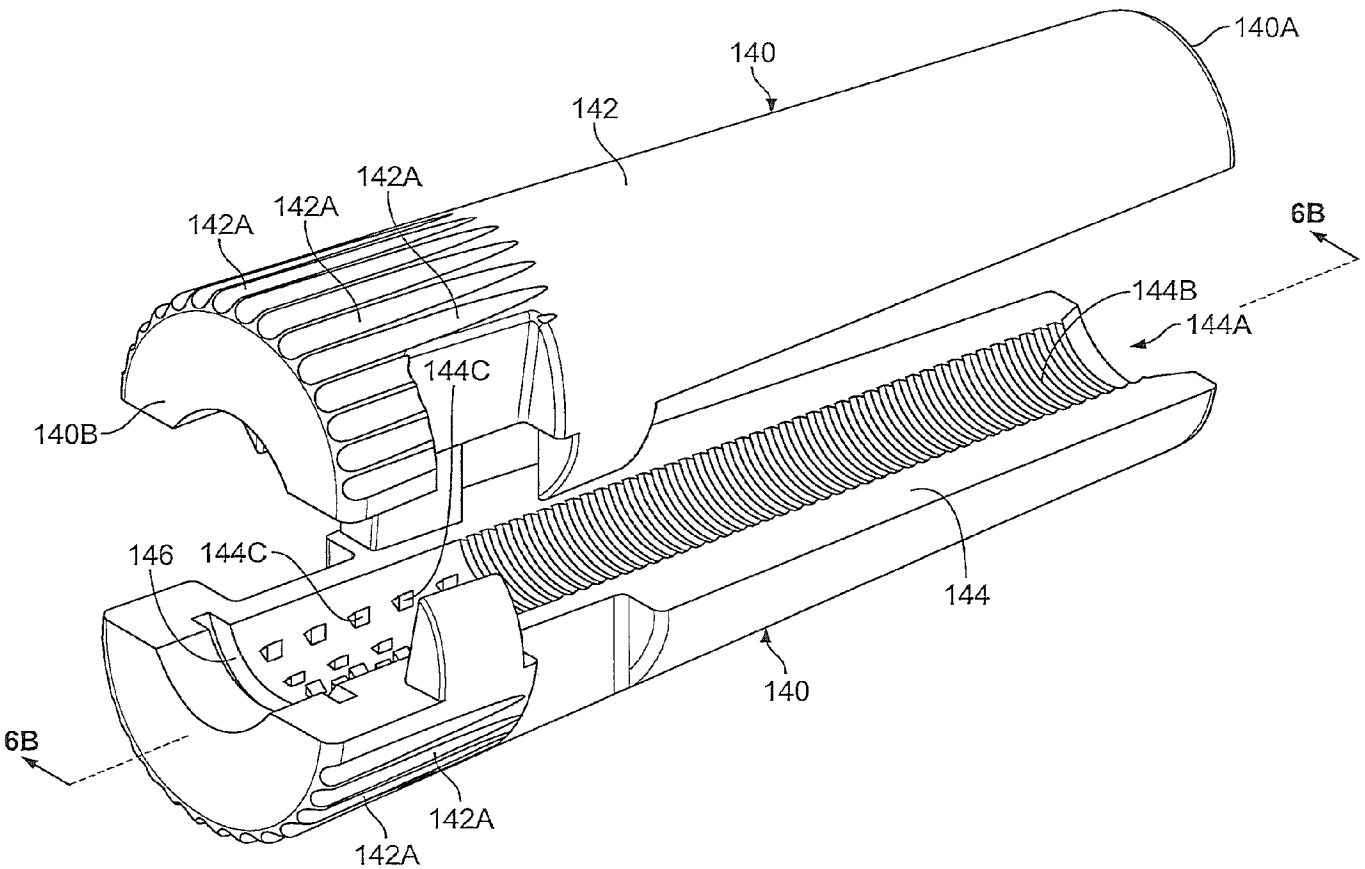
FIG. 6A is a perspective view of a pair of jaw members forming a part of the automatic cable clamp connector of FIG. 1.

With reference to FIG. 6A, each jaw member 140 extends axially from a front end 140A to a rear end 140B, and has outer and inner surfaces 142 and 144, respectively. Each outer surface 142 is generally semi-frusto-conical in shape so that it generally complements or conforms to the shape of the housing inner surface 112 and the jaw member 140 constitutes a wedge tapering from end 140B to end 140A. As best seen in FIG. 6A, axially extending, circumferentially spaced apart ribs, teeth, ridges, projections or serrations 142A are defined on the outer surface 142. According to some embodiments, the serrations 142A extend substantially parallel to the connector axis A-A and the direction of axial travel of the jaws 140. The inner surface 144 defines an axially extending, semi-cylindrical channel 144A. A semi-annular retainer slot 146 is defined in the inner surface 144 proximate the rear end 140B. In the illustrated embodiment, each jaw member 140 constitutes a jaw along substantially its full length; however, jaw members of other configurations may be employed in other embodiments of the invention. For example, the at least one jaw member 140 can be a multiple of jaw members whereupon the functions of any/all teeth, ribs, ridges, projections or serrations are separated out into the multiple jaw members as opposed to being contained within the same jaw set.

Integral front conductor mechanical grip enhancing features or teeth 144B and rear conductor penetration and electrical contact enhancing features or teeth 144C project inwardly from the inner surface 144 into the channel 144A of each jaw member 140. According to some embodiments, the teeth 144B are different in shape and functionality from the teeth 144C. According to some embodiments, the teeth 144C are substantially sharp and the teeth 144B are relatively dull as compared to the teeth 144C. The teeth 144C may be characterized as more aggressive than the teeth 144B.

Figure 6B:
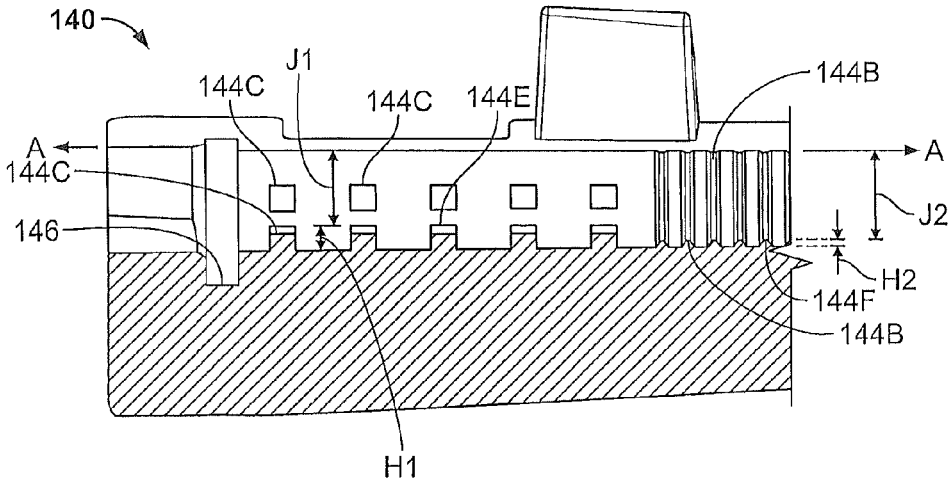
FIG. 6B is a cross-sectional view of the jaw member of FIG. 6A taken along the line 6B-6B of FIG. 6A.
Figure 6C:
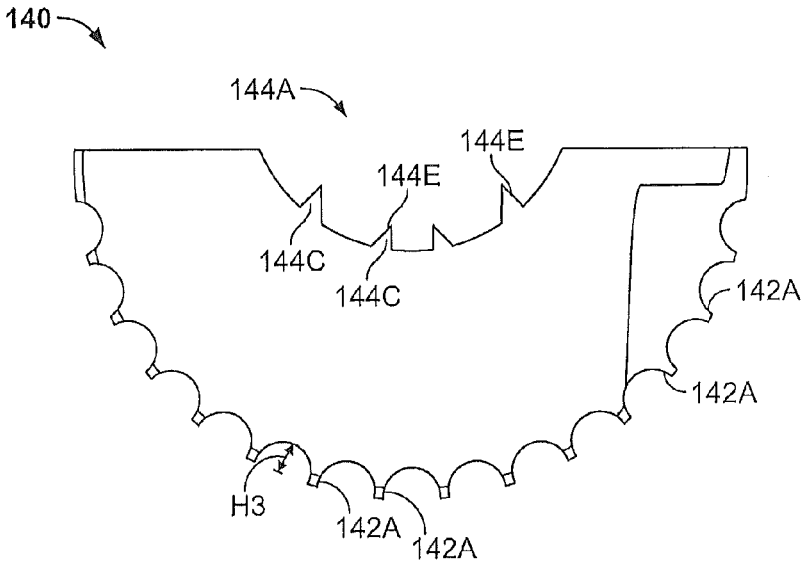
FIG. 6C is an end view of the jaw member of FIG. 6A.

With reference to FIGS. 6A-6C, the exemplary electrical contact teeth 144C each have a free, distal or leading edge 144E that is sharp. By contrast, the leading edges 144F of the teeth 144B are relatively dull. The teeth 144C are axially and radially spaced apart from one another. According to some embodiments, the teeth 144B are semi-circular ribs. According to some embodiments, the leading edges 144E of the teeth 144C extend substantially parallel to the connector axis A-A and the direction of axial travel of the jaws 140. According to some embodiments, the leading edges 144F of the teeth or ribs 144B extend transversely and, in some embodiments, substantially perpendicular to the connector axis A-A.

According to some embodiments, each tooth 144C has a height H1 (FIG. 6B) in the range of from about 0.020 to 0.080 inch. According to some embodiments, the height H1 of each tooth 144C is in the range of from about 2 to 8 times greater than the height 112 (FIG. 6B) of the teeth 144B. According to some embodiments, the distance J1 (FIG. 6B) between the leading edges 144E of the teeth 144C and the central axis A-A of the connector 100 is less than the distance J2 (FIG. 6B) between the leading edges 144F of the teeth 144B and the central axis A-A. According to some embodiments, the distance J1 is between about 2 to 8 times less than the distance J2.

The jaw members 140 may be formed of any suitable electrically conductive material or materials. According to some embodiments, the jaw members 140 are formed of steel, copper or aluminum.

The trigger mechanism 150 (FIG. 4) includes a trigger post 152, and a pair of retainer arms 154 hingedly coupled to the trigger post 152 by a hinge connection 156 (e.g., a hinge pin). The hinge connection 156 permits the arms 154 to pivot relative to the post 152 and each other about a pivot axis C-C extending transversely to the connector axis A-A. A cup shaped receiver feature 152A is provided on the trigger post 152 and includes a plurality of radially inwardly deflectable fingers 152C. The trigger post 152 further includes retainer projections 152B.

Figure 4:
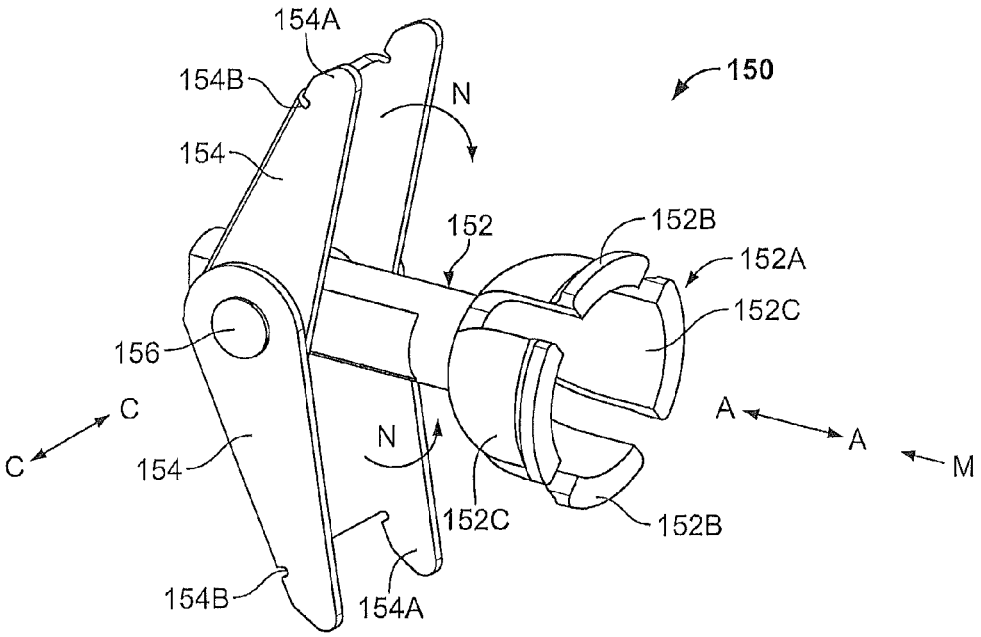
FIG. 4 is a perspective view of a trigger mechanism forming a part of the automatic cable clamp connector of FIG. 1 in a retaining position.

The trigger mechanism 150 is, until actuated, disposed in a retaining position as shown in FIGS. 3 and 4. The retainer arms 154 are widely extended so that an end tab 154A of each arm 154 is seated in a respective one of the radially opposed retainer slots 118 and the edges of the housing 110 are received in notches 154B. The jaw retainer projections 152B are seated in the jaw retainer slots 146 (FIG. 6A). In this manner, the receiver feature 152A is positively axially and radially located with respect to the jaw members 140 and the jaw members 140 are positively axially positioned with respect to the housing 110.

The trigger mechanism components 152, 154, 156 may be formed of any suitable materials. According to some embodiments, the trigger post 152 and the arms 154 are formed of a polymeric material (e.g., polyoxymethylene (POM) such as Delrin™) and the hinge pin 156 is formed of a polymeric material or metal. According to some embodiments, a biasing device (e.g., a torsion spring or leaf spring) is mounted in the trigger mechanism 150 to bias the arms 154 into the open position. Alternatively, the trigger mechanism may have more or fewer than two hinged arms 154.

The spring 160 is captured between the trigger mechanism 150 and the stop 168 in an axially compressed position as shown in FIG. 3. More particularly, the spring 160 has a rear end 160B abutting the stop 168, and a front end 160A abutting the rear sides of the retainer arms 154. An axially extending passage 162 is defined in the spring 160. According to some embodiments, the spring 160 is a coil spring as shown. According to some embodiments, the spring 160 is formed of a metal such as spring steel. According to some embodiments, the spring 160 has a spring force in the range of from about 20 lbs to 400 lbs.

The sealant retainer membrane 130 extends axially from a front end 130A to a rear end 130B. The membrane 130 has a tubular sidewall 134A and an end wall 134B (at the rear end 130B) defining a sealant chamber 132 and an entrance opening 132A (at the front end 130A) communicating with the chamber 132. An anchor section 134D is captured between the outer circumference of the mating section 120B of the funnel 120 and the inner circumference of the housing 110. A jaw section 134E of the membrane 130 extends axially between the jaw members 140. According to some embodiments, the membrane 130 includes a gathered or baffled slack length or expansion section 134C. The outer surface of the membrane 130 and the inner surface of the housing section 111 define a tubular void V radially interposed therebetween.

According to some embodiments, the membrane 130 has an overall length L1 (FIG. 3) in the range of from about 2 inches to 12 inches (depending on cable size). According to some embodiments, the jaw section 134E has a length L2 in the range of from about 0.5 to 6 inches. According to some embodiments, the chamber 132 has an inner diameter D (prior to insertion of the conductor 20) in the range of from about ⅛ to 1 inch. According to some embodiments, the membrane 130 has a thickness T in the range of from about 0.001 to 0.040 inch.

The membrane 130 may be formed of any suitable material. According to some embodiments, the membrane 130 is formed of a flexible material. According to some embodiments, the membrane 130 is elastically expandable radially and/or axially. According to some embodiments, the membrane 130 is formed of an elastomeric material. Suitable elastomeric materials may include latex. According to some embodiments, the membrane 130 is formed of a material having a Young's Modulus in the range of from about 0.02 GPa to 0.03 GPa.

The chamber 132 is partially or fully filled with the sealant 138. The sealant 138 is a flowable material capable of inhibiting corrosion and protecting surfaces coated or covered by the sealant 138 from the environment (e.g., moisture and contaminants).

According to some embodiments, the sealant 138 is a grease. In some embodiments, the sealant 138 is a silicone grease. Other greases may include petroleum or synthetic greases.

According to some embodiments, the sealant 138 is a wax. Suitable waxes may include paraffin, microcrystalline, and carnauba.

According to some embodiments, the sealant 138 is a gel. In some embodiments, the sealant is a silicone gel. Suitable gels may include gels as disclosed in U.S. Pat. No. 7,736,165 to Bukovnik et al., the disclosure of which is incorporated here by reference.

According to some embodiments, the sealant 138 extends from a rear end 138B substantially coincident with the rear end 130B of the membrane 130 (i.e., the closed end of the chamber 132 is filled with the sealant 138) to a front end 138A. In some embodiments, the front end 138A extends to the pilot cap 124 and seals the end opening 116. In some embodiments, the front end 138A of the sealant 138 is located inward of the end opening 116 so that a lead end section of the chamber 132 is not filled with the sealant 138. According to some embodiments, the sealant 138 is substantially free of voids from the end 138A to the end 138B.

The connector 100 can be used as follows in accordance with embodiments of the present invention to couple the connector 100 to an end of the conductor 20. The connector 100 is initially configured as shown in FIG. 3, and may be configured in this manner at the factory and as supplied to the installer. The pilot cap 124 is seated in the opening 116, the trigger assembly 150 is in the retaining position, the spring 160 is retained in its compressed position by the trigger mechanism 150, and the jaw members 140 are retained in place by the trigger mechanism 150.

The free end 20A of the conductor 20 is inserted into the passage 114 through the opening 116 in an insertion direction M (FIG. 3; along the axis A-A) and may be guided by the funnel 120. The installer continues to insert the conductor 20 in the direction M so that the pilot cap 124 is seated on the free end 20A and dislodged from the funnel 120. The conductor 20 (with the pilot cap 124 mounted thereon) continues to slide axially into and through the chamber 132 of the membrane 130 until the free end 20A and the pilot cap 124 are seated in the receiver feature 152A of the trigger assembly 150. The pilot cap 124 may prevent the strands of the conductor 20 from separating.

The installer further forces the conductor 20 in the direction M so that the cable end 20A pushes the trigger post 152 in the direction M. As a result, the retainer arms 154 pivot about the hinge 156 in radially converging directions N (FIG.

Figure 5:
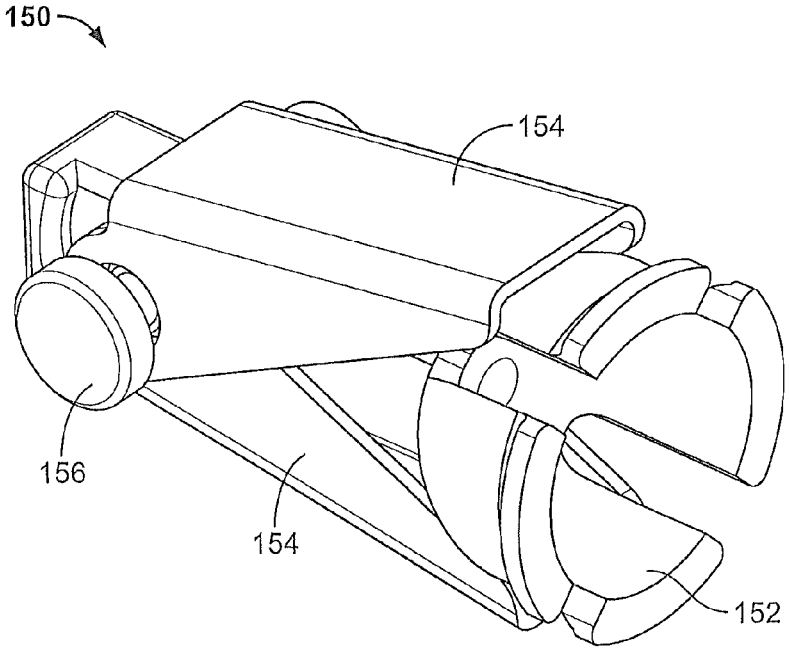
FIG. 5 is a perspective view of the trigger mechanism of FIG. 4 in a triggered, collapsed position.
Figure 7:
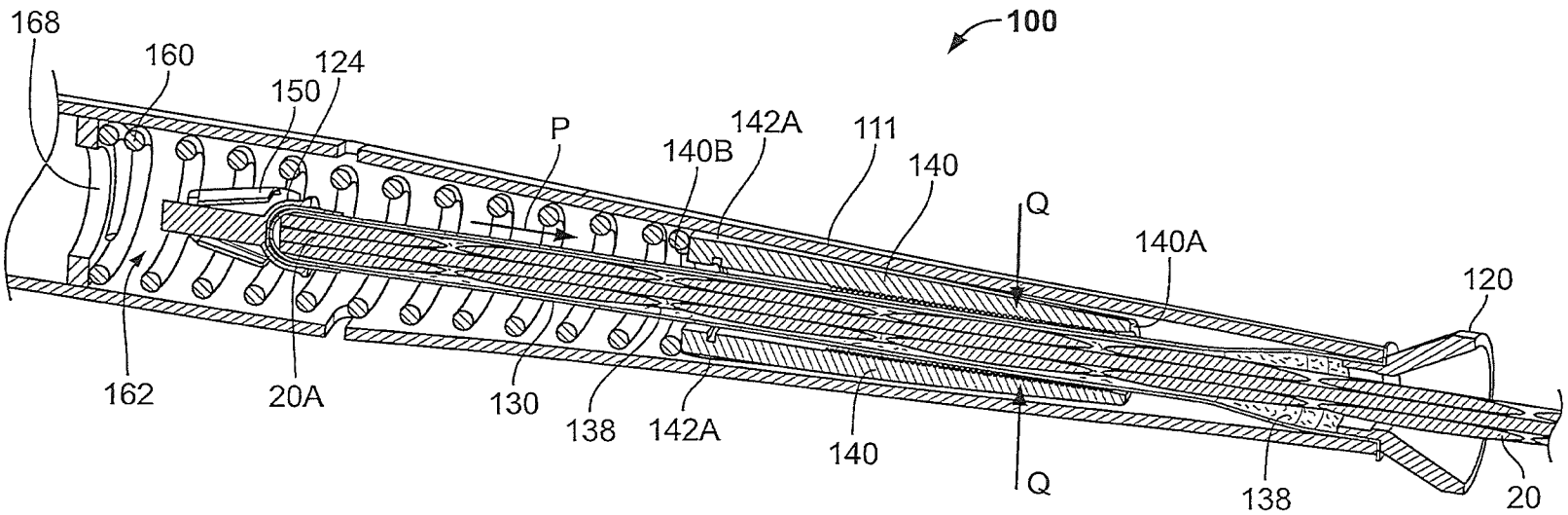
FIG. 7 is a perspective, cross-sectional view of the automatic cable clamp connector of FIG. 1 with a conductor installed therein.
Figure 8:
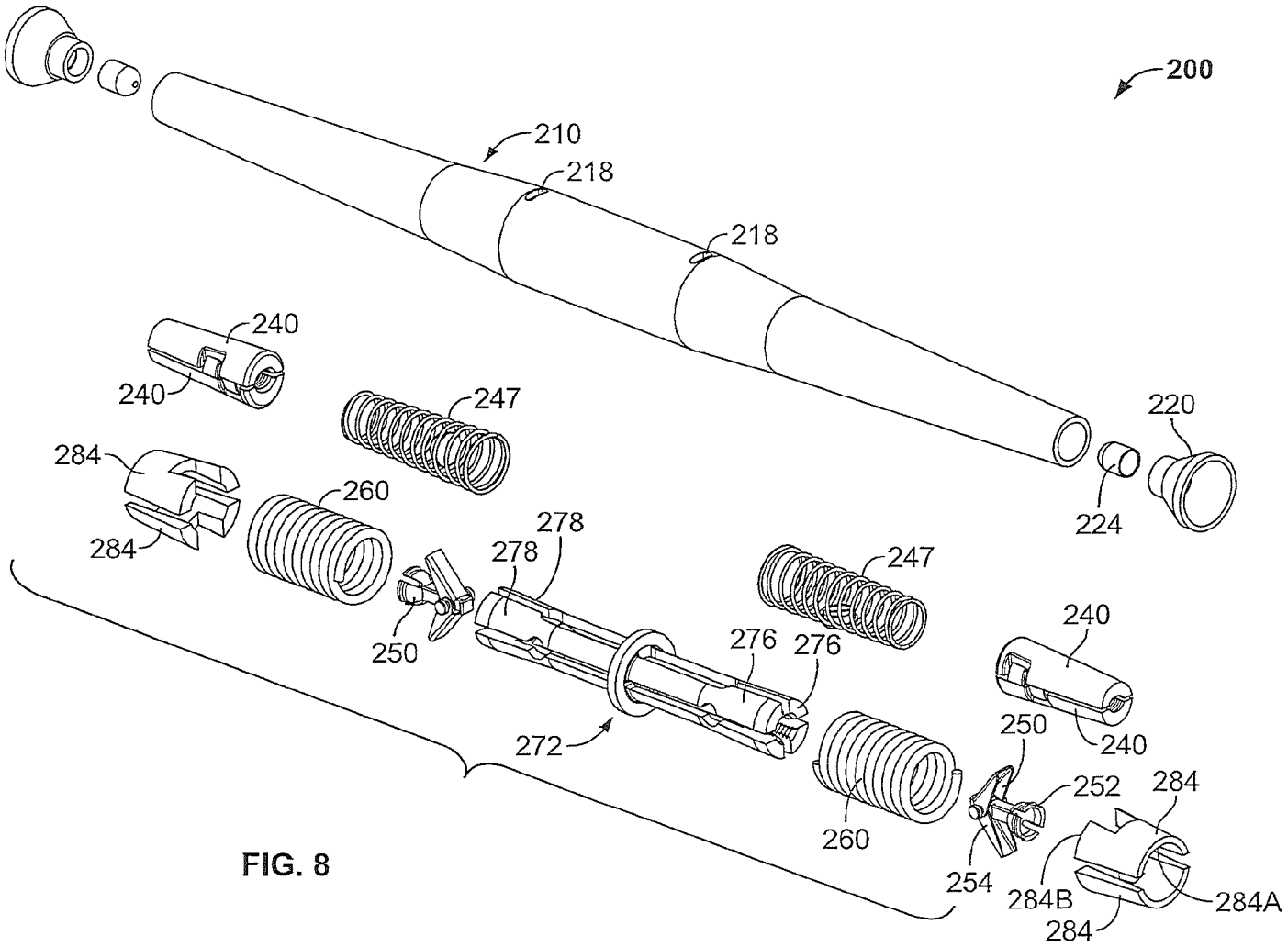
FIG. 8 is an exploded, perspective view of an automatic cable clamp connector according to further embodiments of the invention.

4) thereby disengaging the distal ends of the arms 154 from the slots 118. The trigger mechanism 150 is thereby radially collapsed toward the axis A-A into a releasing, actuating or collapsed position as shown in FIGS. 5 and 7. The spring 160, now released from the trigger mechanism 150, rapidly decompresses and axially extends in a return direction P (FIG. 7) to drive the jaw members 140 in the direction P relative to the housing section 111. The spring 160 travels over the released trigger mechanism 150 so that the trigger mechanism 150 is received in the passage 162 of the spring 160.

As the jaw members 140 are driven in the direction P with the conductor 20 disposed radially therebetween, the ramp or taper of the housing section 111 forces the jaw members 140 to radially converge and clamp onto the conductor 20 and the membrane 130 (which still envelops the conductor 20) and to apply radially compressive clamping loads Q. The continuing load from the spring 160 and the frictional interlock between the outer surfaces 142 of the jaw members 140 and the inner surface 112 of the housing 110 can prevent the jaw members 140 from being displaced opposite the direction P, thereby ensuring the conductor 20 remains tightly grasped and radially loaded by the jaw members 140. In some embodiments, a withdrawal tension on the conductor 20 can also assist in maintaining or increasing the jaw clamping force by pulling the jaw members 140 toward the end 102.

Mechanical interlock and electrical coupling between the jaw members 140 (and thereby the conductor 20) and the housing section 111 can be facilitated or improved by the serrations 142A (FIG. 6A). The serrations 142A can cut or bite into the housing section 111 to cut through contaminants or corrosion and provide electrical contact points. According to some embodiments, each serration 142A has a height 113 (FIG. 6C) in the range of from about 0.015 to 0.080 inch.

As the conductor 20 is inserted into the connector 100 as described above, the sealant 138 is displaced and coats the conductor 20. In some embodiments, some of the displaced sealant 138 is exuded out of the membrane 130 through the opening 132A. The expansion section 134C may be extended to accommodate the conductor 20 or axial extension of the membrane 130 toward the trigger mechanism 150.

When the trigger mechanism 150 is actuated and the jaw members 140 clamp on to the membrane 130, the rear teeth 144C will cut through or pierce the membrane 130 and the sealant 138 and contact or embed in the conductor 20. In this manner, the membrane 130, the sealant 138 and the teeth 144C cooperate to create an environmentally sealed or protected electrical connection between the jaw members 140 and the conductor 20. This sealing arrangement can greatly improve corrosion protection as well as the service life of the connector 100.

The aggressive (sharp and pronounced) rear teeth 144C of the jaw members 140 can be particularly, primarily or exclusively adapted to electrically couple the jaw members 140 and the conductor 20. The front teeth 144B (more dull and shallow than the rear teeth 144C) may be comparatively better adapted to mechanically couple the jaw members 140 to the conductor 20. More particularly, the rear teeth 144C are shaped to penetrate, bite, cut or embed into the outer surface of the conductor 20. That is, the teeth 144C may be configured to penetrate through the outer surface and into the metal of the conductor 20 body or a strand or strands thereof. The teeth 144C may cut through an oxide layer, if present. The sharp tips, limited widths and extended heights of the teeth 144C each tend to enhance the ability of the teeth 144C to embed in the clamped conductor 20 for improved electrical engagement. By contrast, the lower height, greater width and duller edges of the front teeth 144B can enhance the ability of the teeth 144B to mechanically grasp and retain the clamped conductor 20.

Advantageously, the front teeth 144B can support some or all of the tension load on the conductor 20 so that the rear teeth 144C can be shaped to facilitate their conductor penetration, electrical contact function without concern, or with less concern, for withstanding tension loading from the conductor 20. For this purpose, according to some embodiments and as illustrated, the electrical contact teeth 144C are located axially inward or behind the mechanical grip teeth 144B. According to some embodiments, less than 80% of the conductor tension load is supported by or taken up by the rear teeth 144C and, according to some embodiments, less than about 10%. According to some embodiments, substantially none of the tension load from the conductor 20 is applied to the teeth 144C. According to some embodiments, at least 5% of the conductor tension load is taken up by the front teeth 144B and, according to some embodiments, at least 1%.

In some embodiments, the membrane 130 is expandable so that it can radially stretch to accommodate the conductor 20. In some embodiments, the membrane 130 is elastically radially expandable. According to some embodiments, upon installation of the conductor 20 therein, the membrane 130 elastically radially expands and thereafter exerts a persistent elastic radially compressive load on the sealant 138 and the conductor 20. In this way, the membrane 130 can ensure good and consistent contact between the conductor 20 and the sealant 138 and can inhibit formation of voids in the membrane 130.

In some embodiments, the sealant is an elastically elongatable gel. When the conductor 20 is inserted into the membrane 130, the sealant 138 is displaced and thereby elastically elongated. The elastically elongated gel exerts an elastic return force that applies or manifests as a persistent compressive load of the sealant 138 on the conductor 20.

The cable 30 can be installed in and permanently coupled with the opposite side of the connector 100 using the automatic, force-assisted connecting system 108 in the same manner as described above for the automatic connecting system 106 to thereby form the in-line splice connection 10.

The connector 100 can be configured such that the connecting system 106 and the connecting system 108 tightly and reliably clamp onto the conductor 20 and the conductor 30 without the application of tension to the conductors 20, 30. According to some embodiments, the connector 100 is adapted to form a splice or connection with each conductor 20, 30 that is compliant with American National Standards Institute (ANSI) C119.4-2006 (titled "Connectors for Use Between Aluminum-to-Aluminum or Aluminum-to-Copper Conductors") with zero tension on the conductors 20 and 30. The connector 100 can thus be an effective and operative slack span splice connector.

With reference to FIGS. 8-13, an automatic, force-assisted cable clamp connector 200 according to further embodiments of the invention is shown therein. The connector 200 may be used to form an in-line splice connection 40 with a pair of conductors 20, 30.

The connector 200 has a lengthwise axis A-A (FIG. 10) and extends longitudinally from a first (hereinafter 'right') end 202 to an opposing second (hereinafter 'left') end 204. The connector 200 has a tubular housing 210, which may be formed of the materials described above with respect to the housing 110. A first force-assisted, automatic connecting system 206 is provided proximate the right end 202 and a second force-assisted, automatic connecting system 208 is provided proximate the left end 204. The connecting systems 206 and 208 may be constructed and operate in the same manner and, therefore, only the connecting system 206 will be described in detail below, it being understood that this description likewise applies to the connecting system 208.

The automatic connecting system 206 includes a right side section 211 of the housing 210 (extending from an axial center of the housing 210 to proximate the end 202) corresponding to the housing section 111, a guide funnel 220 corresponding to the guide funnel 120, a pilot cap 224 corresponding to the pilot cap 124, a pair of opposed front jaw members 240, a trigger mechanism 250 corresponding to the trigger mechanism 150, a rear biasing member (as shown, a coil spring) 260, a rear jaw system 270, a front biasing member (as shown, a coil spring) 247, and a jaw plug 249. According to some embodiments (not shown), the connecting system 206 may further include a sealant and a sealant containment membrane (not shown) corresponding to the sealant 138 and the membrane 130.

The front jaw members 240 have interior teeth 244B and may be constructed in the same manner as the jaw members 140 except that, as illustrated, the jaw members 240 may be provided without retainer slots or two different types of teeth. The jaw members 240 are held in place in the housing section 211 by the stop plug 249, which presses the jaw members 240 radially outwardly. In the illustrated embodiment, each jaw member 240 constitutes a jaw along substantially its full length; however, jaw members of other configurations may be employed in other embodiments of the invention.

The jaw system 270 includes a unitary jaw member 272 and a pair of actuator wedges 284 mounted on the jaw member 272 radially between the jaw member 272 and the housing section 211. The jaw member 272 is mounted so as to remain axially fixed in the housing section 211 while the wedges 284 are axially displaceable to actuate the jaw system 270 as described below.

Figure 12:
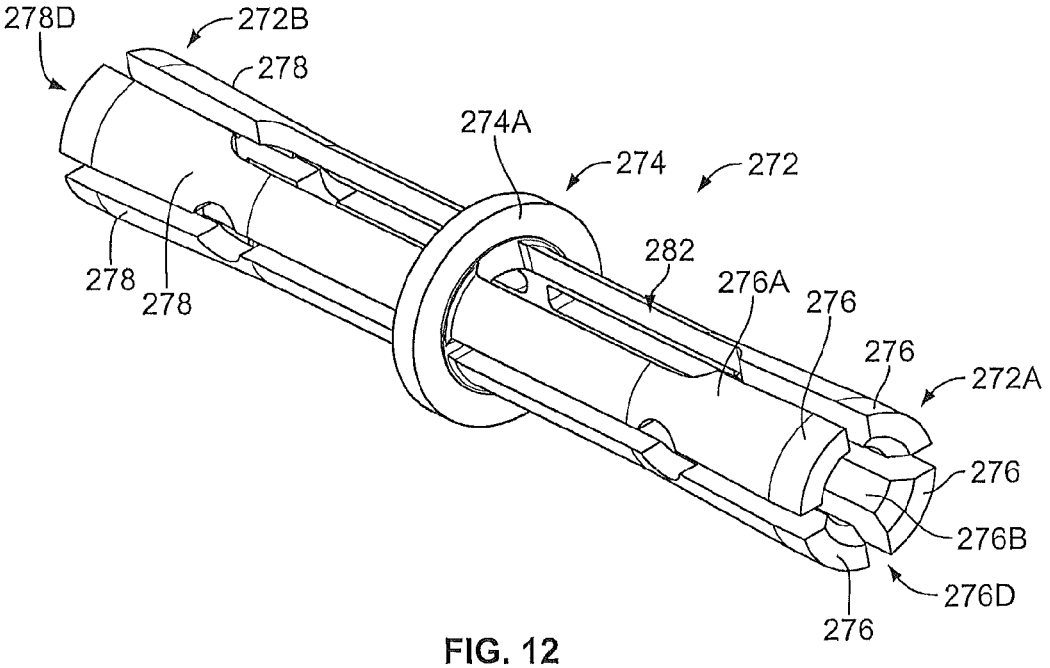
FIG. 12 is a perspective view of a jaw member forming a part of the automatic cable clamp connector of FIG. 8.

With reference to FIG. 12, the jaw member 272 extends axially from a first (right) end 272A to an opposing second (left) end 272B. The jaw member 272 includes a hub portion 274, four right side fingers or jaw members 276 extending axially an in cantilevered fashion from the hub portion 274, and four left side fingers or jaw members 278 extending axially in cantilevered fashion from the hub portion 274. An annular stop flange 274A projects radially from the hub 274. The jaw members 276 collectively define a right side conductor receiving passage or slot 276D and the jaw members 278 collectively define a left side conductor receiving passage or slot 278D. Each set of jaw members 276, 278 also defines a trigger receiving passage 280. The jaw members 276 each have a semi-cylindrical outer surface 276A, a semi-cylindrical inner surface 276B (defining the passage 276D), and conductor gripping features or teeth 276C on the surfaces 276B. Axially extending trigger clearance slots 282 are defined between the jaw members 276. The jaw members 278 include corresponding structures (not labeled).

The wedges 284 each have a semi-cylindrical inner surface 284C (which may be complementary to the jaw outer surfaces 276A), and a semi frusto-conical outer surface 284D (which may be complementary to the inner surface of the housing section 211) that tapers from a rear end 284B to a front end 284A.

The jaw member 272 may be formed of any suitable electrically conductive material or materials. According to some embodiments, the jaw member 272 is formed of steel, copper or aluminum.

The wedges 284 may be formed of any suitable electrically conductive material. According to some embodiments, the wedges 284 are formed of steel, copper or aluminum.

The jaw member 272 is axially fixed in the interior cavity 214 of the housing 210 such that the stop flange 274A is centrally located, the jaw members 276 extend axially toward the end 202, and the jaw members 278 extend axially toward the end 204. For example, the hub portion 274 may be welded, staked, or otherwise secured in the housing 210. The right side wedges 284 are slidably mounted on the jaw members 276 radially between the jaw members 276 and the housing 210, and the left side wedges 284 are slidably mounted on the jaw members 278 radially between the jaw members 278 and the housing 210.

The trigger mechanism 250 corresponds to the trigger mechanism 150 and may be constructed and operable in the same manner. The retainer arms 254 are interlocked with retainer slots 218 in the housing 210 with the trigger mechanism 250 in the ready position. The trigger post 252 resides in the conductor receiving slot 276D.

Figure 10:
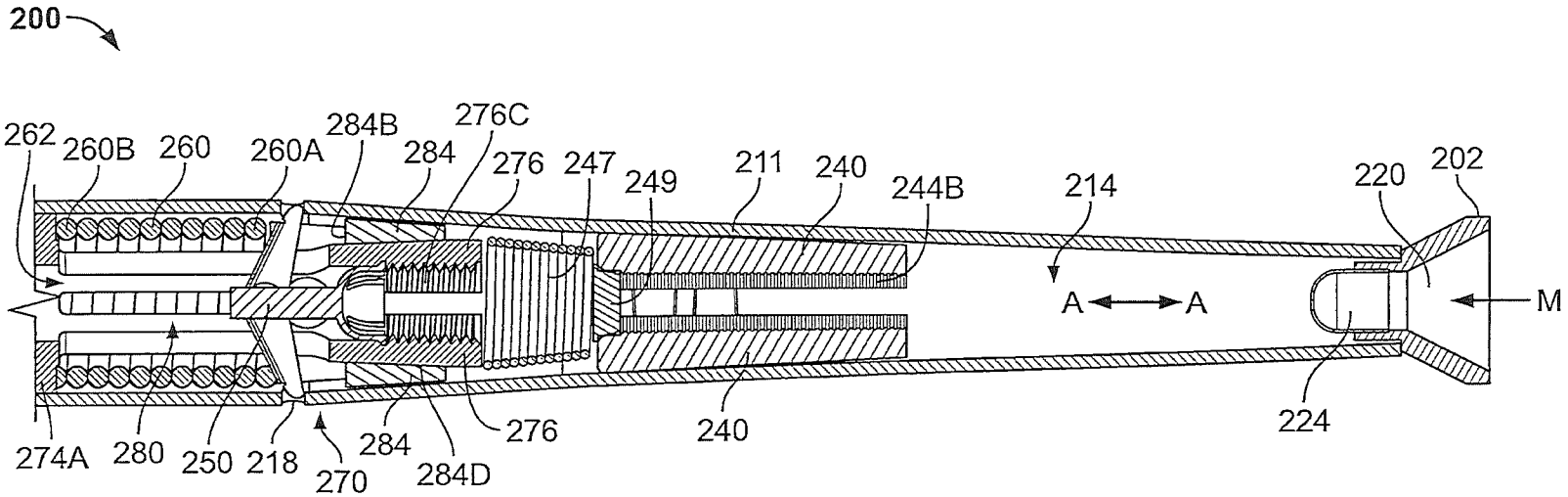
FIG. 10 is a fragmentary, cross-sectional view of the automatic cable clamp connector of FIG. 8.
Figure 11:
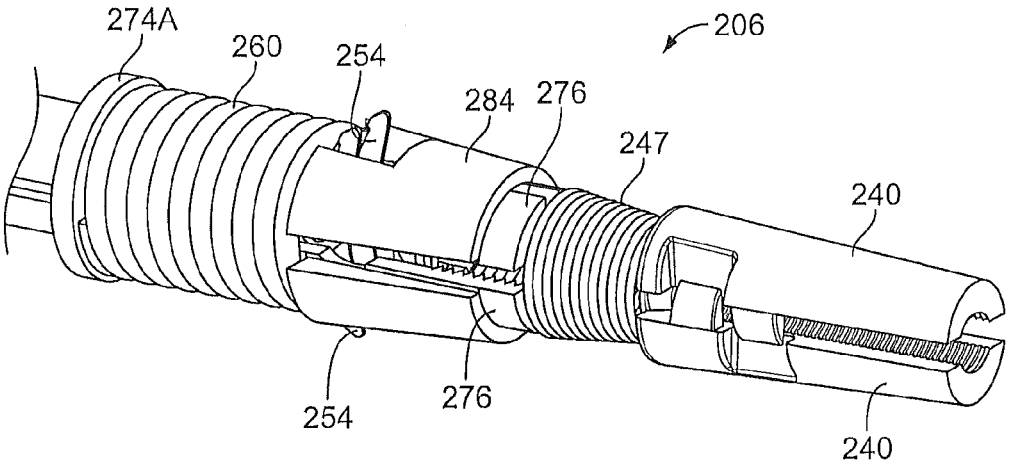
FIG. 11 is a perspective view of a connecting system forming a part of the automatic cable clamp connector of FIG. 8.

The rear spring 260 has a front end 260A and a rear end 260B and defines an inner spring passage 262. Until the connecting system 206 is triggered, the spring 260 is maintained in a compressed position as shown in FIG. 10 between the stop flange 274A and the trigger mechanism 250 with the end 260A abutting the arms 254 and the end 260B abutting the stop flange 274A.

The front spring 247 is captured, in an axially compressed position, between the front end of the jaw members 276 and the rear end of the jaw members 240.

Figure 9:
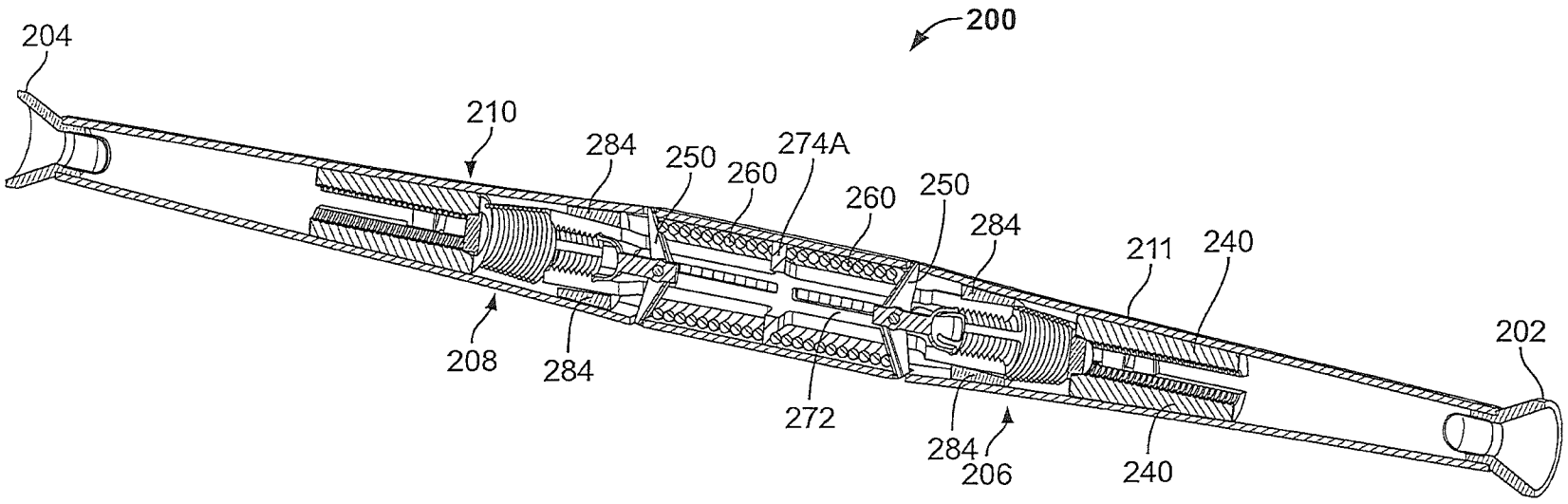
FIG. 9 is a perspective, cross-sectional view of the automatic cable clamp connector of FIG. 8.

The connector 100 can be used as follows in accordance with embodiments of the invention to couple the connector 200 to an end of the conductor 20. The connector 100 is initially configured as shown in FIGS. 9 and 10 and may be configured in this manner at the factory and as supplied to the installer.

The free end of the conductor 20 is inserted into the passage 214 through the opening 216 in an insertion direction M (FIG. 10; along the axis A-A) and may be guided by the funnel 220.

The installer continues to insert the conductor 20 in the direction M so that the pilot cap 224 is seated on the free end 20A and dislodged from the funnel 220.

The installer further forces the conductor 20 in the direction M so that the free end 20A travels through the front jaw members 240, dislodges the plug 249 from the jaw members 240 (and into the spring 247), through the rear jaws 276, and into the triggering post 252. When the plug 249 is dislodged, the front spring 247 is permitted to push the jaw members 240 toward the end 202 in a direction U (FIG. 13) to clamp on to the conductor 20.

Figure 13:
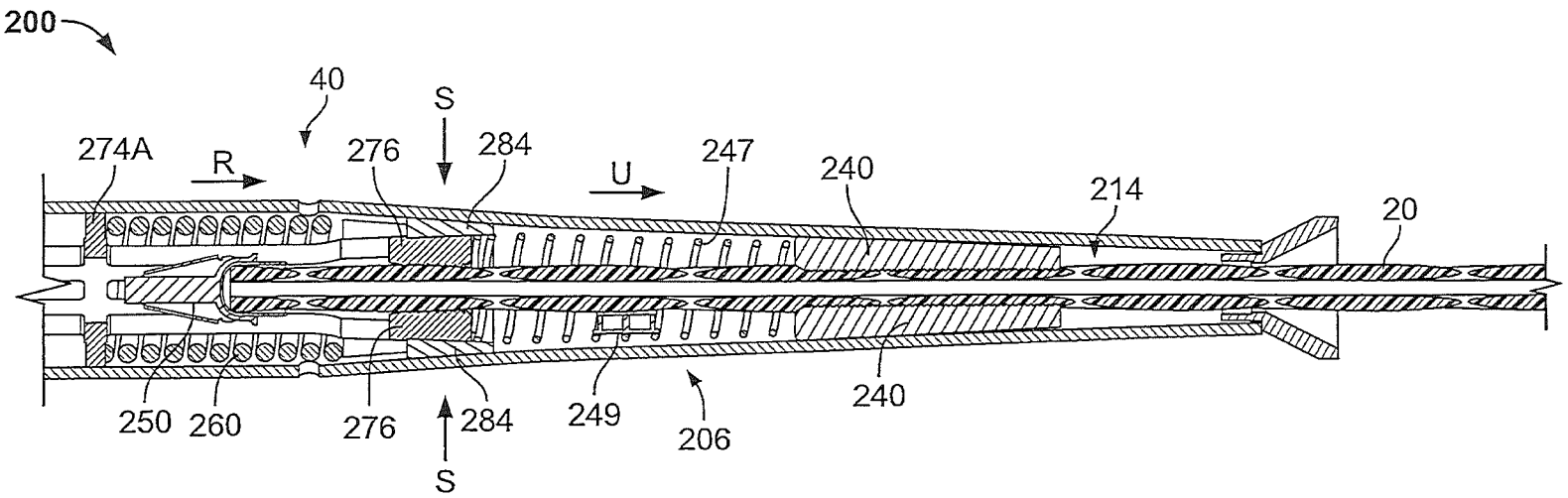
FIG. 13 is a cross-sectional view of the automatic cable clamp connector of FIG. 8 with a conductor installed therein.

As the installer further forces the conductor 20 in the direction M, the trigger post 252 is driven in the direction M, causing the arms 254 and the trigger mechanism 250 to disconnect from the slots 218 and radially collapse as described above for the trigger mechanism 150. The rear spring 260, now released from the trigger mechanism 250, rapidly decompresses and axially extends in a return direction R (FIG. 13) to drive the wedges 284 in the direction R relative to the housing 210 and the jaws 276. As a result of the cooperating geometries of the wedges 284, the jaws 276 and the housing 210, the axially displacement of the wedges 284 compresses or deflects the jaw 276 radially inwardly (in directions S; FIG. 13) so that the conductor 20 is clamped between the jaws 276. The radially inward clamp loading by the jaws 276 is maintained by the load of the spring 260 and the frictional interlock between the wedges 284, the jaws 276 and the housing 210. The conductor 20 is thereby permanently connected to and clamped in the connector 200. The released spring 260 passes over the collapsed trigger mechanism 250 and/or the trigger mechanism 250 is pushed back into the spring 260 so that the trigger mechanism 250 is retained in the passage 262.

The rear jaw teeth 276C may be relatively aggressive (sharp and pronounced) to facilitate electrical connection with the conductor 20 while the front jaw teeth 244B may be less aggressive (less sharp and less pronounced) than the teeth 276C.

The conductor 30 can be installed in the other end of the connector 200 using the automatic connecting system 208. The conductor 30 is thereby engaged by and clamped in the jaw members 278 of the jaw member 272. As a result, the conductor 200 provides direct electrical continuity between the conductors 20 and 30 through the unitary jaw member 272.

According to some embodiments, the jaw member 272 is monolithic. As used herein, "monolithic" means an object that is a single, unitary piece formed or composed of a material without joints or seams.

Alternatively, the jaw plug 249 may be omitted so that the front spring 247 and the front jaw members 240 are not retained prior to insertion of the conductor 20.

According to some embodiments, the rear spring 260 is a relatively strong spring (i.e., high spring force) and the front spring 247 is a weaker spring than the spring 260. According to some embodiments, the rear spring 260 has a spring force in the range of from about 20 to 400 lbs and the front spring 247 has a spring force in the range of from about 0.25 to 20 lbs.

Figure 14:
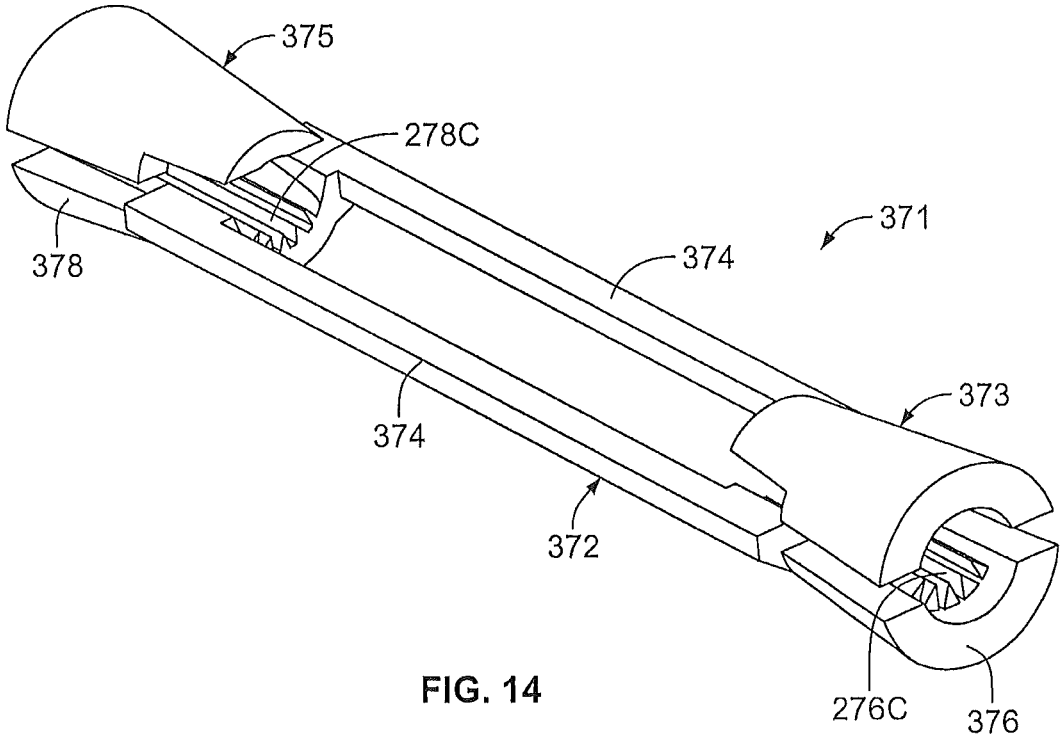
FIG. 14 is a perspective view of a jaw assembly according to further embodiments of the invention.

With reference to FIG. 14, a jaw assembly 371 is shown therein that may be used in place of the jaw member 272 in accordance with further embodiments of the invention. The jaw assembly 371 includes a unitary shared or common jaw member 372, a first (right) jaw member 373, and a second (left) jaw member 375. The jaw member 372 includes a first (right) jaw 376, and a second (left) jaw 378 joined by integral connecting portions 374. The jaws 376, 378 are provided with sharp, pronounced engagement features or teeth 276C, 278C.

The jaw member 372 is axially fixed in the center of the housing 210 in any suitable manner such that the jaw 376 extends into the right side of the interior cavity 214 and the jaw 378 extends into the left side of the opposing interior cavity 214. The jaw members 373 and 375 are positioned radially opposite the jaw members 376 and 378, respectively. The wedges 284 are mounted radially about the jaw members and jaw members 376, 378, 373, 375 as described above. Upon actuation of the trigger mechanism 250, the wedges 284 under the force of the spring 260 radially deflect and load the jaw 376 and the jaw member 373 against the conductor 20, and the jaw 378 and the jaw member 375 against the conductor 30.

The connector 200 may be configured such that the connecting systems 206 and 208 tightly and reliably clamp onto the conductors 20 and 30 without application of tension to the conductors 20, 30. According to some embodiments, the connector 200 is adapt to form a splice or connection with each cable 20, 30 that is compliant with ANSI C119.4-2006 with zero tension on the conductors 20, 30. The connector 100 can thus be an effective and operative slack span splice connector.

Figure 15:
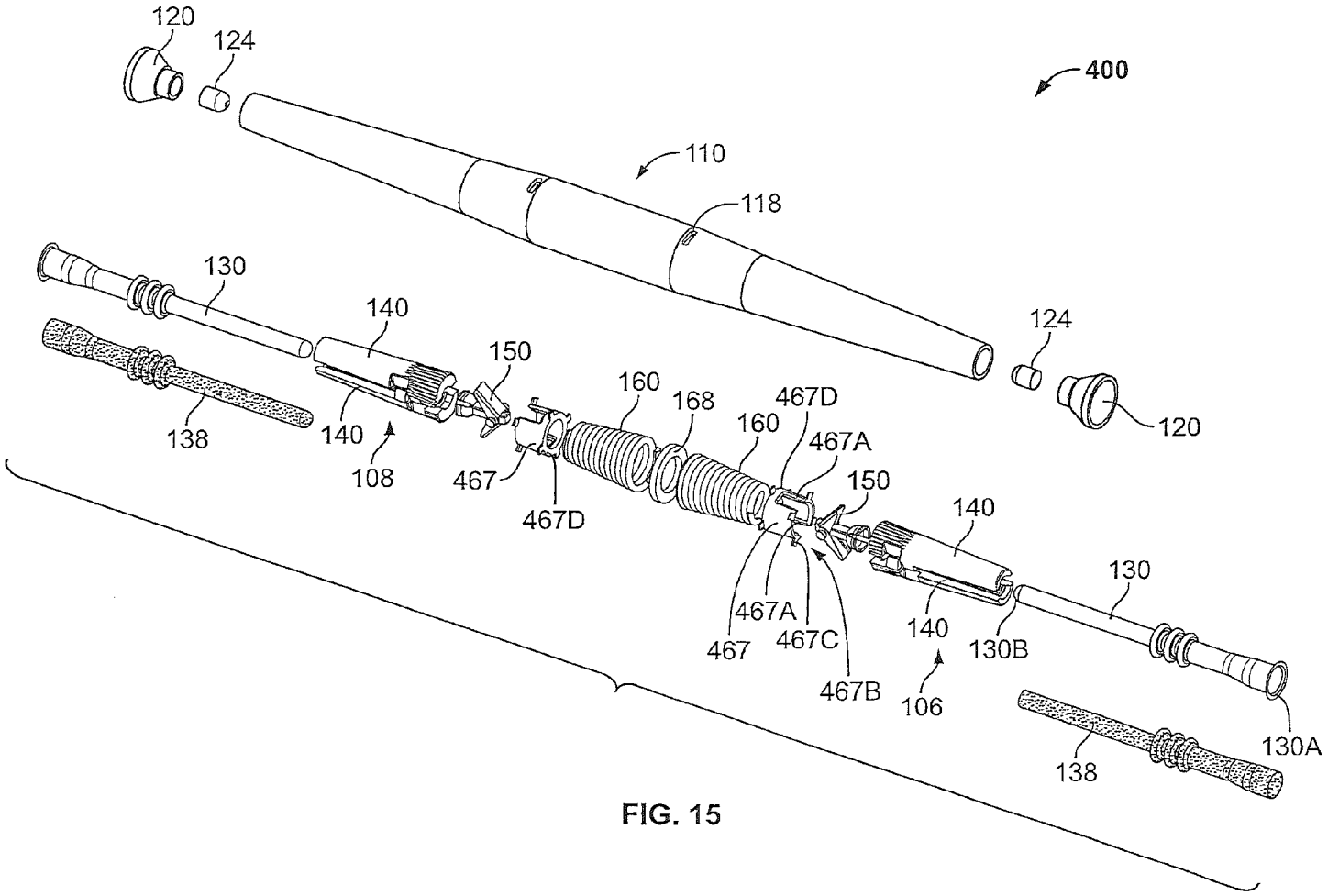
FIG. 15 is an exploded, perspective view of an automatic cable clamp connector according to further embodiments of the invention.

With reference to FIG. 15, a force-assisted automatic cable clamp connector 400 according to further embodiments of the present invention is shown therein. The connector 400 differs from the connector 100 only in that the connector 400 further includes a trigger guide 467 axially interposed between each spring 160 and its associated jaw members 140.

The trigger guide 467 defines an axial through passage 467B and opposed, axially extending side slots 467A, and has a rear abutment face 467D and a front abutment face 467C. Prior to actuation, the arms 154 of the trigger mechanism 150 extend through the slots 467A into engagement with the housing retainer slots 118 as described above with regard to the connector 100. When the trigger mechanism 150 is actuated to collapse the arms 154, the trigger guide 467 through passage 467B assists in guiding the collapsed trigger mechanism 150 into the passage 162 of the spring 160 and may provide a more controlled or consistent collapse of the trigger mechanism 150. The spring 160 abuts the end face 467D and forces the trigger guide 467 to slide axially toward the jaw members 140. The end face 467C abuts the rear ends of the jaw members 140 and in turn forces the jaws 140 axially toward the end of the housing 110 and into clamping engagement with the conductor as described above with regard to the connector 100.

The trigger guide 467 may be particularly beneficial or necessary when the diameter of the front end opening of the spring 160 is only slightly larger than the diameter of the collapsed trigger mechanism 150. The trigger guide 467 may also help to center the front end of the spring 160 in the housing 110. The connector 200 may likewise be modified to include trigger guides.

According to some embodiments, the conductor insertion force required to actuate the trigger mechanism (e.g., the trigger mechanism 150 or 250) (herein, the "triggering force") to release the spring (e.g., spring 160, 260) is less than about 50% of the spring force of the compressed spring 160, 260 (i.e., the spring in the ready position) and, in some embodiments, less than about 20% of the spring force of the compressed spring 160, 260. In some embodiments, the conductor insertion force required to actuate the trigger mechanism 150, 250 is less than about 25 pounds-force and, in some embodiments, less than about 10 pounds-force. In this manner, the connector can be designed to provide sufficient cable clamping force without requiring greater insertion force than can be reliably and safely supplied by the installer without using special tools and by hand.

While particular embodiments have been illustrated and described herein in the form of self-contained, tubular, spring force-assisted, automatic splice connectors, electrical connectors of other types, configurations and constructions may incorporate aspects of the present inventions. For example, a sealant containing membrane as disclosed herein may be employed in a wedge-type electrical connector other than an automatic or force-assisted electrical connector. Various aspects and features as disclosed herein can be provided in an electrical tap connector or other type of connector rather than an end-to-end splice connector.

Many alterations and modifications may be made by those having ordinary skill in the art, given the benefit of present disclosure, without departing from the spirit and scope of the invention. Therefore, it must be understood that the illustrated embodiments have been set forth only for the purposes of example, and that it should not be taken as limiting the invention as defined by the following claims. The following claims, therefore, are to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the invention.

That which is claimed is:

1. An electrical connector for forming a mechanical and electrical coupling with an electrical conductor, the electrical connector comprising:

a tubular housing having a connector axis, the housing defining a conductor receiving opening and an interior cavity each configured to receive the conductor along the connector axis;

at least one jaw member;

a spring to force the at least one jaw member to clamp the conductor within the interior cavity; and a trigger mechanism configured to retain the spring in a compressed position and, responsive to insertion of the conductor into the interior cavity through the conductor receiving opening, to collapse and permit the spring to decompress and force the at least one jaw member to clamp the conductor within the interior cavity;

wherein:

the trigger mechanism includes first and second retainer arms coupled to one another by a hinge connection; and the trigger mechanism is collapsible by relatively pivoting the first and second retainer arms about the hinge connection.

2. The electrical connector of claim 1 wherein:

the trigger mechanism includes an actuator member coupled to the retainer arms and positioned to engage the conductor when the conductor is inserted into the interior cavity; and the trigger mechanism is operative to collapse the first and second retainer arms about the hinge connection when the conductor displaces the actuator member.

3. The electrical connector of claim 1 wherein:

the spring defines a spring passage; and when the spring decompresses and forces the at least one jaw member to clamp the conductor within the interior cavity and the trigger mechanism is collapsed, the collapsed trigger mechanism is received in the spring passage.

4. The electrical connector of claim 1 wherein the trigger mechanism includes a jaw retainer feature engaging the at least one jaw member to hold the at least one jaw member in place relative to the housing.

5. The electrical connector of claim 1 wherein a cable insertion force required to actuate the trigger mechanism to collapse and permit the spring to decompress and force the at least one jaw member to clamp the conductor is less than about 50% of a spring force of the spring in the compressed position.

6. The electrical connector of claim 1 wherein a cable insertion force required to actuate the trigger mechanism to collapse and permit the spring to decompress and force the at least one jaw member to clamp the conductor is less than about 25 pounds-force.

7. The electrical connector of claim 1 wherein:

the electrical connector is configured to clamp and electrically contact the first conductor within the interior cavity; and the at least one jaw member includes electrical contact enhancing teeth configured to penetrate into an outer surface of the conductor to electrically couple the at least one jaw member to the conductor.

8. The electrical connector of claim 7 wherein the at least one jaw member further includes mechanical grip teeth configured to grip the outer surface of the conductor to support a conductor tension load from the conductor and thereby reduce or prevent application of the conductor tension load to the electrical contact enhancing teeth.

9. The electrical connector of claim 8 wherein the electrical contact enhancing teeth have a more aggressive profile than the mechanical grip teeth.

10. The electrical connector of claim 3 further including a trigger guide configured to guide the collapsed trigger mechanism into the spring passage.

* * * * *